US007322893B2

(12) United States Patent
Bright

(10) Patent No.: US 7,322,893 B2
(45) Date of Patent: Jan. 29, 2008

(54) COLLAPSIBLE FOOTBALL TACKLING BLOCK

(76) Inventor: Timothy Bright, 6218 Ridge, St. Louis, MO (US) 63133

( * ) Notice: Subject to any disclaimer, the term of this patent is extended or adjusted under 35 U.S.C. 154(b) by 265 days.

(21) Appl. No.: 11/098,976

(22) Filed: Apr. 5, 2005

(65) Prior Publication Data

US 2005/0250084 A1 Nov. 10, 2005

Related U.S. Application Data

(60) Provisional application No. 60/559,469, filed on Apr. 5, 2004.

(51) Int. Cl.
*A63B 69/34* (2006.01)
*A63B 69/00* (2006.01)

(52) U.S. Cl. ..... 473/441; 473/443

(58) Field of Classification Search ..... 473/422, 473/442, 444, 445; 482/112, 90, 133, 130, 482/129; 434/251
See application file for complete search history.

(56) References Cited

U.S. PATENT DOCUMENTS 2,934,343 A * 4/1960 Schumacher ..... 473/445
3,218,070 A * 11/1965 Crowther ..... 473/441
3,825,260 A * 7/1974 Thomas, Sr. ..... 473/444
3,942,796 A 3/1976 Bowen
3,997,160 A 12/1976 George
4,294,457 A * 10/1981 Thiboutot ..... 280/20
4,447,056 A 5/1984 Dalton
4,477,076 A 10/1984 Monaco
4,508,341 A 4/1985 Carrington
4,573,680 A 3/1986 McNally
5,013,039 A 5/1991 Cole
5,090,696 A 2/1992 Forrest, Sr.
5,143,372 A 9/1992 Wilson
5,385,523 A 1/1995 Forrest
5,415,552 A 5/1995 Harmon et al.
5,462,272 A 10/1995 Staten
5,474,290 A 12/1995 Rascona et al.
5,743,821 A 4/1998 Wirachowski
6,036,609 A 3/2000 Gilman
6,261,194 B1 7/2001 Hadar et al.

* cited by examiner

*Primary Examiner*—Mitra Aryanpour
(74) *Attorney, Agent, or Firm*—Husch & Eppenberger LLC; H. Frederick Rusche

(57) ABSTRACT

A collapsible football tackling block includes a base; a pad support, wherein the pad support is pivotally connected to the base by a hinge; a detachable support between the pad support and the base; a detachable connection between the one end of the detachable support and an intermediate portion of the pad support; and a detachable connection between a second end of the detachable support and an intermediate portion of the base, wherein the pad support is foldable against the base for storage by detaching at least one of the connections of the detachable support.

18 Claims, 5 Drawing Sheets

COLLAPSIBLE FOOTBALL TACKLING BLOCK

CROSS-REFERENCE TO RELATED APPLICATIONS

This application claims the priority of provisional application Ser. No. 60/559,469, filed Apr. 5, 2004.

TECHNICAL FIELD OF THE INVENTION

The present invention relates generally to sports training equipment and, more particularly, to a collapsible football tackling block.

DESCRIPTION OF THE RELATED ART

Tackling blocks are commonly used by football coaches to instruct and train players to use the proper form when tackling and blocking. Proper instruction concerning blocking and tackling techniques are essential not only for success but also to avoid injury.

While tackling blocks are commonly utilized by schools and leagues, traditional tackling blocks are not practical for use at home. Traditional tackling blocks are large, heavy and cumbersome. They take up a considerable amount of space and are generally left outdoors or stored in large outdoor storage sheds. These characteristics make traditional tackling blocks unsuitable for home use. However, it is frequently the case that a young football player's parents are his or her first coaches. Early instruction to proper form and techniques is critical to minimizing the risk of injury to young players who are just learning the game. The lack of access to a tackling block at home can hinder a parent's efforts to instruct their son or daughter in proper blocking and tackling techniques, thereby limiting the effectiveness of their coaching efforts.

Therefore, it would be desirable to provide a football tackling block that is easily transported and stored, making it more suitable for home use.

The present invention is directed to overcoming one or more of the problems set forth above.

SUMMARY OF THE INVENTION

An aspect of the present invention is to provide a football tackling block that is easily and quickly collapsible for storage.

Another aspect of the present invention is to provide a football tackling block with enhanced cushioning to reduce the risk of injury.

In accordance with the above aspects of the invention, there is provided a collapsible football tackling block that includes a base; a pad support, wherein the pad support is pivotally connected to the base by a hinge; a detachable support between the pad support and the base; a detachable connection between the one end of the detachable support and an intermediate portion of the pad support; and a detachable connection between a second end of the detachable support and an intermediate portion of the base, wherein the pad support is foldable against the base for storage by detaching at least one of the connections of the detachable support.

In another embodiment, the detachable support includes a shock absorber or similar pressurized fluid cylinder.

These aspects are merely illustrative of the various aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION

In the following detailed description, numerous specific details are set forth in order to provide a thorough understanding of the invention. However, it will be understood by those skilled in the art that the present invention may be practiced without these specific details. For example, well-known methods, procedures, and components have not been described in detail so as not to obscure the present invention.

Figure 1:
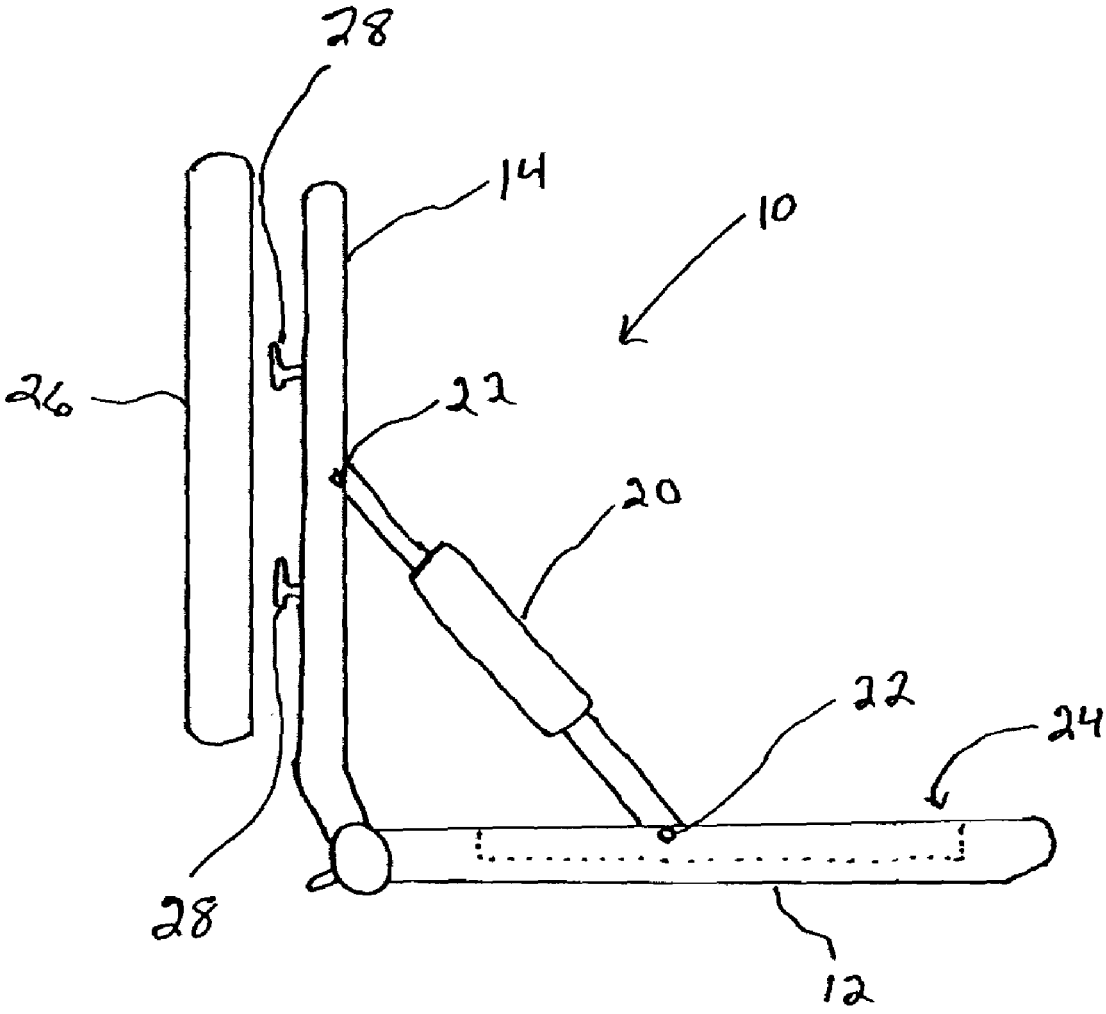
FIG. 1 is a side schematic view of a collapsible football tackling block in an upright position for use according to one embodiment of the present invention.
Figure 1A:
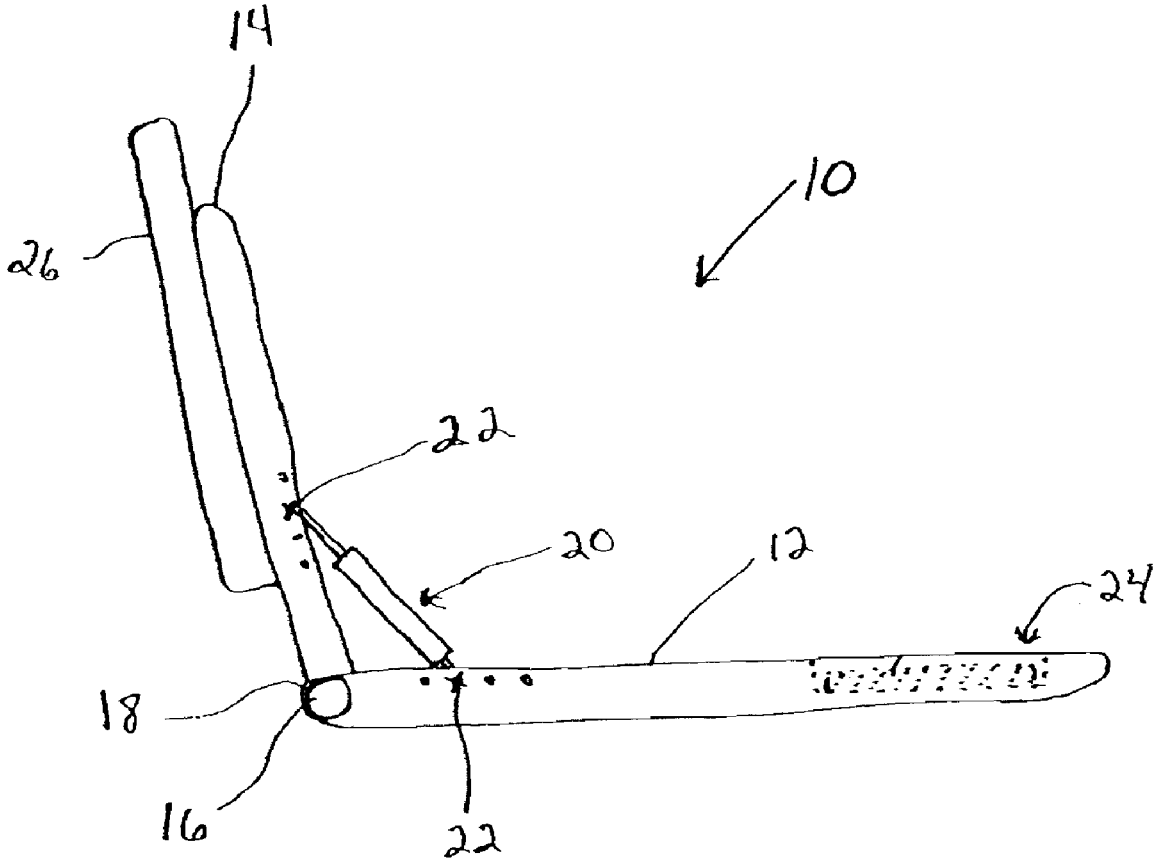
FIG. 1A is a side schematic view of another embodiment of a collapsible football tackling block.
Figure 2:
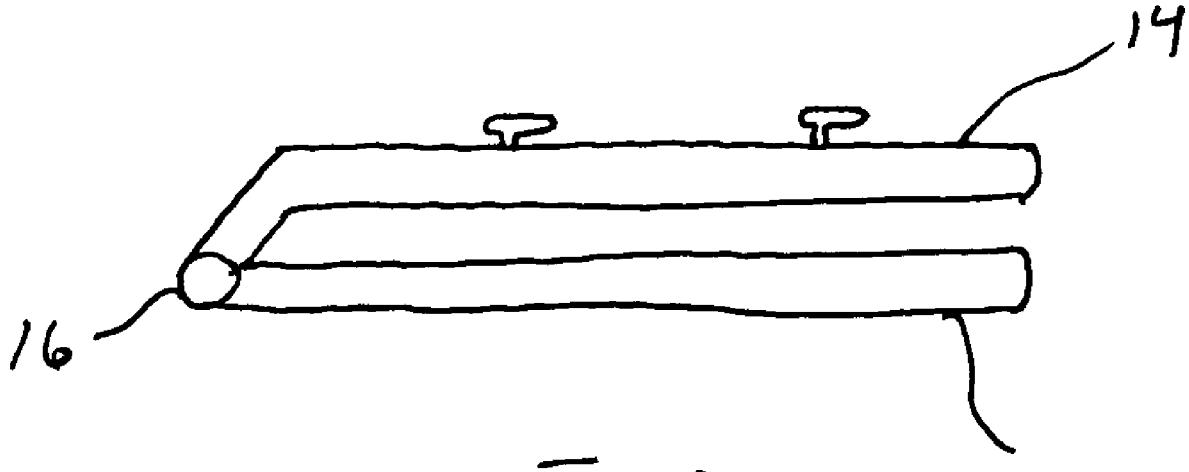
FIG. 2 is a schematic view of the collapsible football tackling block of FIG. 1 in a collapsed position for storage.
Figure 3:
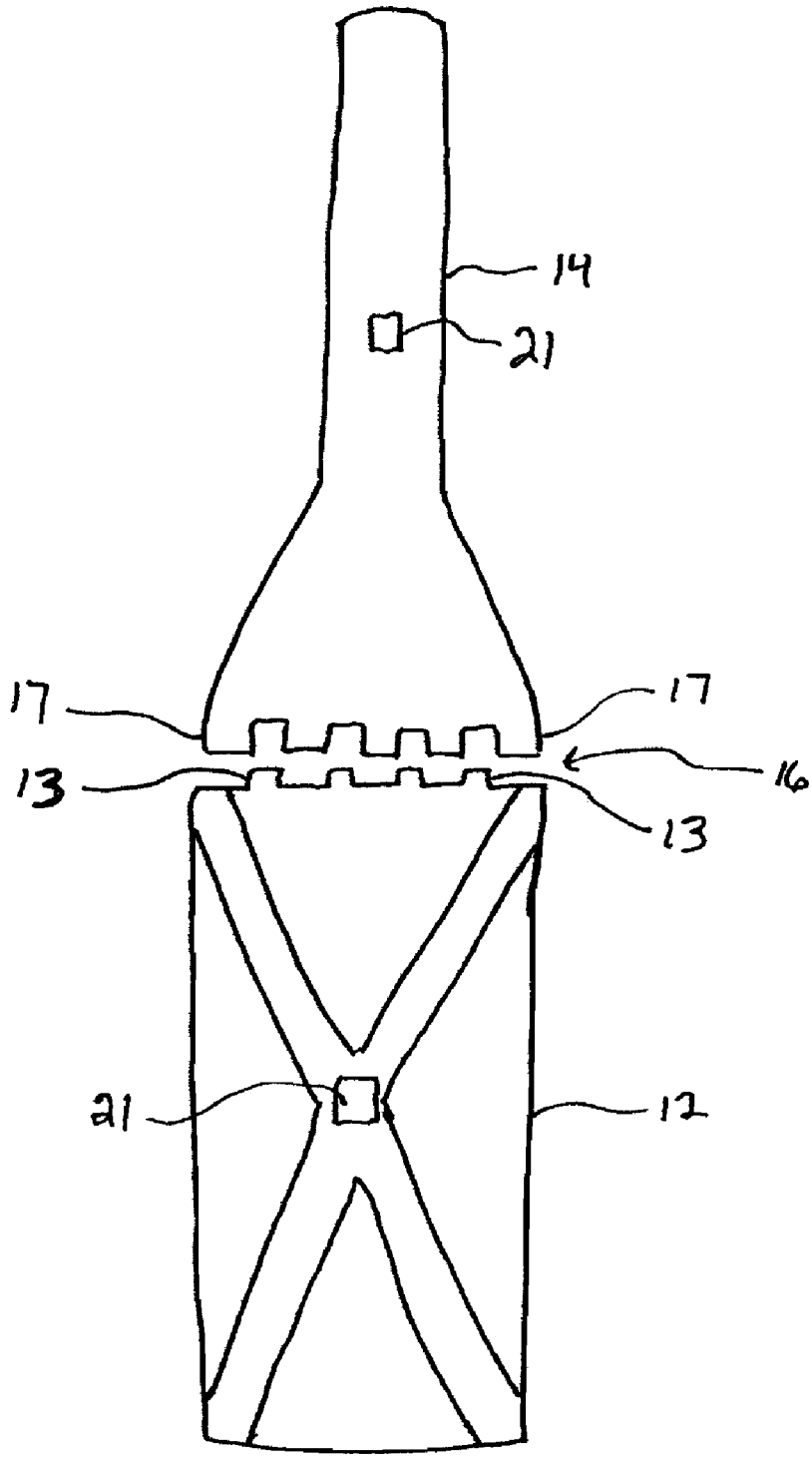
FIG. 3 is plan schematic view of a collapsible football tackling block in an upright position for use.

FIGS. 1-3 illustrate a collapsible football tackling block 10 according to one embodiment of the present invention. The collapsible tackling block 10 is arranged for quick conversion from a relatively flat storage position to an upright "use" position and back again. FIG. 1 shows the tackling block in the upright position, and FIG. 2 shows the tackling block in the storage position.

The collapsible tackling block 10 includes a base 12 and pad support 14 that are pivotably attached to one another by a hinge 16. The hinge 16 may be of any suitable construction. In one embodiment, the hinge 16 includes a spring 18 to bias the base 12 and pad support 14 towards either the storage position or the upright position. The hinge 16 may also be integral with the structures of the base 12 and pad support 14. The hinge 16 preferably connects one end of the base 12 with an end of the pad support 14. In the embodiment illustrated in FIG. 3, the hinge includes a series of tabs 13 associated with the base 12 and a series of recesses 15 associated with the pad support 14. The tabs 13 are provided with a transverse hole extending through each tab. Portions 17 of the pad support 14 surrounding the recesses 15 are similarly provided with a transverse hole extending through each such portion. When the tabs 13 are inserted into the recesses 15 the transverse holes associated with tabs 13 and the portions 17 can be aligned such that a rod or similar elongated member 34 can be inserted therethrough to pivotably interconnect the base 12 and the pad support 14.

In the non-limiting embodiments shown in FIGS. 1-3, the pad support 14 is slightly narrower than the base 12 and fits within a pair of ears 32 on the base 12. However, other arrangements of the pad support 14 and base 12 are expressly contemplated as falling within the scope of the invention. In these alternate arrangements, the pad support 14 may be slightly wider than the base 12 and provided with structures similar to ears 32. In the embodiment shown in FIG. 3, the base 12 is formed in a generally rectangular shape, while the pad support 14 includes a bottom portion that narrows towards the top of the support to provide the required dimensions for a pad 26.

Figure 4:
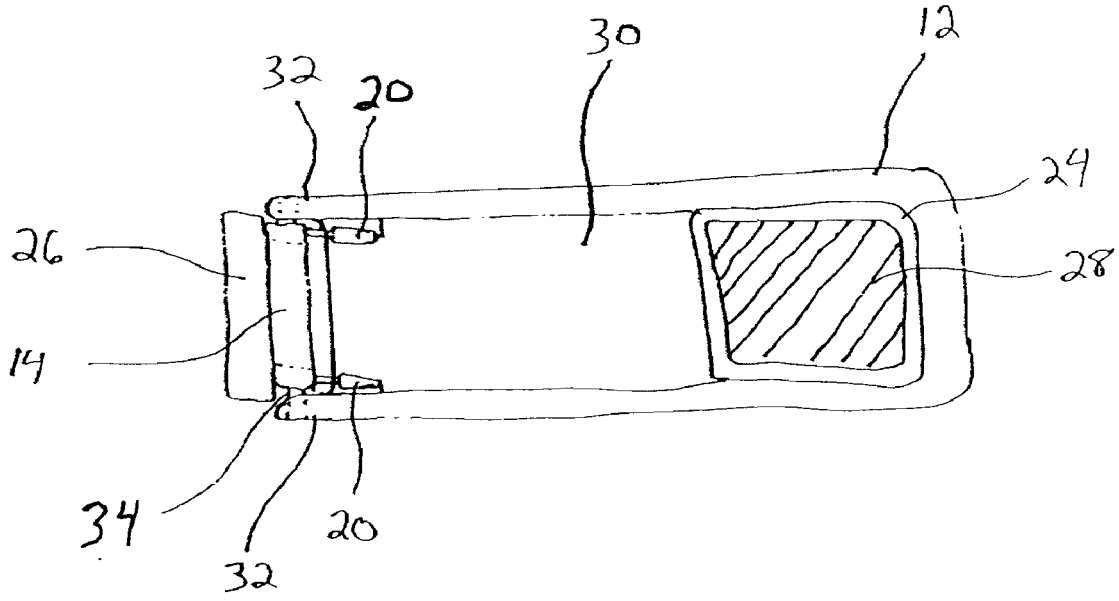
FIG. 4 is plan schematic view of an alternate embodiment of a collapsible football tackling block in an upright position.

When the tackling block 10 is in the upright position, the pad support 14 is supported relative to the base 12 by at least one detachable support 20. In the embodiment of FIG. 3, a single detachable support 20 is used to connect the pad support 14 and the base 12. However, in the embodiment shown in FIG. 4, two detachable supports 20 are used to support the pad support 14. In one embodiment, the detachable support 20 is a fixed member. In a preferred embodiment, the detachable support 20 is a shock absorber or similar air or fluid controlled piston and cylinder device. However, other suitable embodiments utilize other devices capable of controlled motion of one piece relative to the second piece, such as a leaf spring or other spring type. In the preferred embodiment, when a player strikes the pad support, the shock absorber allows the pad support to "give" slightly, thereby reducing the chance for serious injury.

One end of the detachable support 20 is detachably connected to an intermediate point of the base 12, while the opposite end of the shock absorber 20 is detachably connected to an intermediate point of the pad support 14. In the preferred embodiment, the detachable connection between the detachable support 20 and both the base 12 and pad support 14 is a simple pin connection. However, other detachable connections, for example, screws, bolts, or cotter pins are utilized. The detachable connection may include mounting flanges 21 connected to the base 12 and pad support 14 by welding or other suitable means. In the preferred embodiment, pins 22 are inserted through matching holes in the detachable support 20 and the base 12 and pad support 14 in order to secure the tackling block 10 in the upright position. To prepare the tackling block 10 for storage, one or both pins 22 are removed from the holes to detach at least one end of the detachable support 20 from either the base 12 or pad support 14. One end of the detachable support 20 may remain connected to either the base 12 or pad support 14 and rotated out of the way in order to facilitate reattachment of the support 20 later. The pin connection between the detachable support 20 and the base 12 and pad support 14 may include a single hole in the base 12 and pad support 14 to accept pins 22. However, in an alternate embodiment, either or both of the base 12 and pad support 14 may include a series of holes to accept the pins 22. This arrangement allows numerous variations in the angle of the pad support 14 relative to the base 12 when the tackling block 10 is in the upright position.

The base 12 is formed from any suitable elongated structure. Such structure may include a flat panel or a U-shaped or H-shaped frame structure as non-limiting examples. In the preferred embodiment, the base 12 is weighted for stability. The weight may be an intrinsic component of the material used for the base 12. Alternatively, the weight may be introduced by a separate weighted element. In one embodiment, the base 12 is primarily composed of a rigid yet relatively lightweight material having a reservoir 24, said reservoir 24 preferably located at the end of the base 12 opposite of the hinge 16. The reservoir 24 may be filled with a heavier solid material, for example, a weightlifting plate, or water, sand, or another suitable material. In this arrangement, the tackling block 10 remains relatively lightweight for more convenient transportation but can still be provided with the weight necessary for stability during use. The base may also be provided with a depressed area 30, which provides a space within which the pad support may rest when the tackling block is in the storage position to provide an even smaller profile for the block.

Similarly to the base, the pad support 14 can be constructed from a number of suitable elongated structures. A pad 26 is slipped over the pad support 14 to provide cushioning. In a preferred embodiment, the width and depth of the pad support 14 are sized to accommodate a standard tackling block pad. The pad 26 may be permanently or removably connected with the pad support 14 in a number of suitable manners, including hook and loop fasteners, lacing, gluing, sonic welding, or any other suitable method. In the embodiment of FIG. 3, the pad support 14 is provided with a number of hooks 28 onto which the pad 26 may be hung.

Other objects, features and advantages of the present invention will be apparent to those skilled in the art. While preferred embodiments of the present invention have been illustrated and described, this has been by way of illustration and the invention should not be limited except as required by the scope of the appended claims and their equivalents.

What is claimed is:

1. A collapsible football tackling block, comprising:
- a transportable, free-standing base frame having first and second ends;
- a pad frame having first and second ends and wherein said first end of said pad frame is pivotally connected to said first end of said base frame;
- a shock absorber with first and second ends;
- a detachable connection between said first end of said shock absorber and an intermediate portion of said pad frame; and
- a detachable connection between said second end of said shock absorber and an intermediate portion of said base frame, wherein said pad frame is foldable against said base frame by detaching at least one of said detachable connections of said shock absorber and rotating said pad frame about said pivotal connection between said pad frame and said base frame.

2. The collapsible football tackling block as set forth in claim 1, wherein said pivotal connection between said first end of said pad frame and said first end of said base frame comprises a spring-loaded hinge.

3. The collapsible football tackling block as set forth in claim 1, wherein said pivotal connection between said first end of said pad frame and said first end of said base frame comprises:
- a plurality of first tabs in said first end of said base frame;
- a plurality of second tabs in said first end of said pad frame; said plurality of second tabs defining a plurality of recessed areas corresponding to and mating with said plurality of first tabs; and
- an elongated member in engagement with and extending through said plurality of first tabs and said plurality of second tabs to pivotally connect said pad frame and said base frame.

4. The collapsible football tackling block as set forth in claim 1, wherein said detachable connection between said second end of said shock absorber and said intermediate portion of said base frame comprises:
- a first mounting bracket on said second end of said shock absorber;
- a second mounting bracket on said intermediate portion of said base frame, said second mounting bracket defining a plurality of mounting locations; and a first removable pin connector in engagement with said first mounting bracket and one of said mounting locations on said second mounting bracket.

5. The collapsible football tackling block as set forth in claim 1, wherein said detachable connection between said first end of said shock absorber and said intermediate portion of said pad frame comprises:

a third mounting bracket on said first end of said shock absorber;

a fourth mounting bracket on said intermediate portion of said pad frame, said fourth mounting bracket defining a plurality of mounting locations; and a second removable pin connector in engagement with said third mounting bracket and one of said mounting locations on said fourth mounting bracket.

6. The collapsible football tackling block as set forth in claim 1, wherein said base frame further comprises a reservoir.

7. The collapsible football tackling block as set forth in claim 6, wherein said reservoir comprises a tank having a valve.

8. A collapsible football tackling block, comprising:

a transportable, free-standing base frame having first and second ends;

a pad frame having first and second ends and wherein said first end of said pad frame is pivotally connected to said first end of said base frame;

a support with first and second ends;

a detachable connection between said first end of said support and an intermediate portion of said pad frame; and a detachable connection between said second end of said support and an intermediate portion of said base frame, wherein said pad frame is foldable against said base frame by detaching at least one of said detachable connections of said support and rotating said pad frame about said pivotal connection between said pad frame and said base frame.

9. The collapsible football tackling block as set forth in claim 8, wherein said support comprises a cushioning mechanism.

10. The collapsible football tackling block as set forth in claim 9, wherein said cushioning mechanism comprises a shock absorber.

11. The collapsible football tackling block as set forth in claim 9, wherein said cushioning mechanism comprises a fluid controlled piston and cylinder device.

12. The collapsible football tackling block as set forth in claim 9, wherein said cushioning mechanism comprises a spring.

13. The collapsible football tackling block as set forth in claim 8, wherein said pivotal connection between said first end of said pad frame and said first end of said base frame comprises a spring-loaded hinge.

14. The collapsible football tackling block as set forth in claim 8, wherein said pivotal connection between said first end of said pad frame and said first end of said base frame comprises:

a plurality of first tabs in said first end of said base frame;

a plurality of second tabs in said first end of said pad frame; said plurality of second tabs defining a plurality of recessed areas corresponding to and mating with said plurality of first tabs; and an elongated member in engagement with and extending through said plurality of first tabs and said plurality of second tabs to pivotally connect said pad frame and said base frame.

15. The collapsible football tackling block as set forth in claim 8, wherein said detachable connection between said second end of said support and said intermediate portion of said base frame comprises:

a first mounting bracket on said second end of said support;

a second mounting bracket on said intermediate portion of said base frame, said second mounting bracket defining a plurality of mounting locations; and a first removable pin connector in engagement with said first mounting bracket and one of said mounting locations on said second mounting bracket.

16. The collapsible football tackling block as set forth in claim 8, wherein said detachable connection between said first end of said support and said intermediate portion of said pad frame comprises:

a third mounting bracket on said first end of said support;

a fourth mounting bracket on said intermediate portion of said pad frame, said fourth mounting bracket defining a plurality of mounting locations; and a second removable pin connector in engagement with said third mounting bracket and one of said mounting locations on said fourth mounting bracket.

17. The collapsible football tackling block as set forth in claim 8, wherein said base frame further comprises a reservoir.

18. The collapsible football tackling block as set forth in claim 17, wherein said reservoir comprises a tank having a valve.

* * * * *